US008649725B2

(12) United States Patent
Kimura et al.

(10) Patent No.: US 8,649,725 B2
(45) Date of Patent: Feb. 11, 2014

(54) COLLECTION CONTAINER WITH AN ELASTIC BODY AND IMAGE-FORMING APPARATUS

(75) Inventors: Masamichi Kimura, Yokohama (JP); Ichirou Kawahara, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 351 days.

(21) Appl. No.: 12/917,228

(22) Filed: Nov. 1, 2010

(65) Prior Publication Data

US 2011/0217103 A1 Sep. 8, 2011

(30) Foreign Application Priority Data

Mar. 2, 2010 (JP) ..... 2010-045812

(51) Int. Cl.
*G03G 21/00* (2006.01)

(52) U.S. Cl.
USPC ..... 399/360

(58) Field of Classification Search
USPC ..... 399/360, 359
See application file for complete search history.

(56) References Cited

U.S. PATENT DOCUMENTS

| | | | | |
|---|---|---|---|---|
| 2008/0002997 | A1 | 1/2008 | Watanabe et al. | |
| 2009/0252526 | A1 * | 10/2009 | Kadowaki | 399/99 |

FOREIGN PATENT DOCUMENTS

| | | | | |
|---|---|---|---|---|
| CN | 101165603 | A | | 4/2008 |
| JP | 58054370 | A | * | 3/1983 |
| JP | 62021185 | A | * | 1/1987 |
| JP | 63240580 | A | * | 10/1988 |
| JP | 01277881 | A | | 8/1989 |
| JP | 01277881 | A | * | 11/1989 |
| JP | 11-174917 | A | | 7/1999 |
| JP | 2005-331663 | A | | 12/2005 |
| JP | 2005-331664 | A | | 12/2005 |

OTHER PUBLICATIONS

Chinese Office Action (including Chinese Search Report) dated Oct. 23, 2013 issued in corresponding Chinese Patent Application No. 2013101800858460.

* cited by examiner

*Primary Examiner* — Quana M Grainger
(74) *Attorney, Agent, or Firm* — Sughrue Mion, PLLC

(57) ABSTRACT

A collection container includes: a first receiving unit that receives toner removed from a toner holder, via an aperture; a conveyance member that is provided in the first receiving unit to convey the received toner in a direction across a first direction in which the first receiving unit extends; a toner container that has a width extending in the first direction to receive and store the conveyed toner across the width; an elastic body that supports the toner container against a weight of the toner container so that at least one end of the toner container is movable within a range greater than that of another part of the toner container; and a moving member that moves in accordance with a movement of one end of the toner container, when the elastic body elastically deformed caused by an increase in an amount of toner stored.

8 Claims, 11 Drawing Sheets

COLLECTION CONTAINER WITH AN ELASTIC BODY AND IMAGE-FORMING APPARATUS

CROSS-REFERENCE TO RELATED APPLICATIONS

This application is based on and claims priority under 35 USC 119 from Japanese Patent Application No. 2010-045812 filed on Mar. 2, 2010.

BACKGROUND

Technical Field

The present invention relates to a collection container and an image-forming apparatus.

SUMMARY

According to an aspect of the invention, there is provided a collection container including: a first receiving unit that receives toner removed from a toner holder by a removing member, via an aperture; a conveyance member that is provided in the first receiving unit to convey the received toner in a direction across a first direction in which the first receiving unit extends; a toner container that has a width extending in the first direction to receive and store the toner conveyed by the conveyance member across the width; an elastic body that supports the toner container against a weight of the toner container so that at least one end of the toner container is movable within a range greater than that of another part of the toner container; and a moving member that moves in accordance with a movement of one end of the toner container, when the elastic body elastically deformed caused by an increase in an amount of toner stored in the toner container.

BRIEF DESCRIPTION OF THE DRAWINGS

An exemplary embodiment of the present invention will now be described in detail based on the following figures, wherein.

DETAILED DESCRIPTION

Exemplary Embodiment

Figure 1:
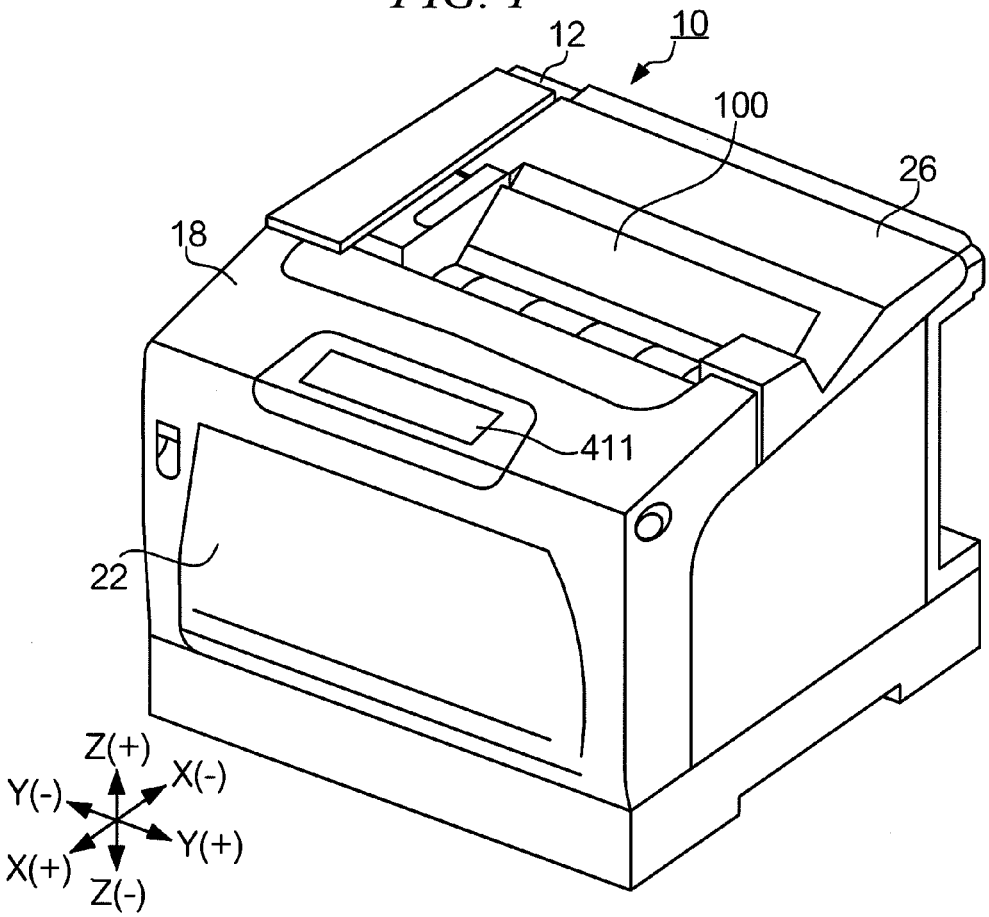
FIG. 1 shows an exterior of image-forming apparatus 10 according to the exemplary embodiment of the present invention.
Figure 2:
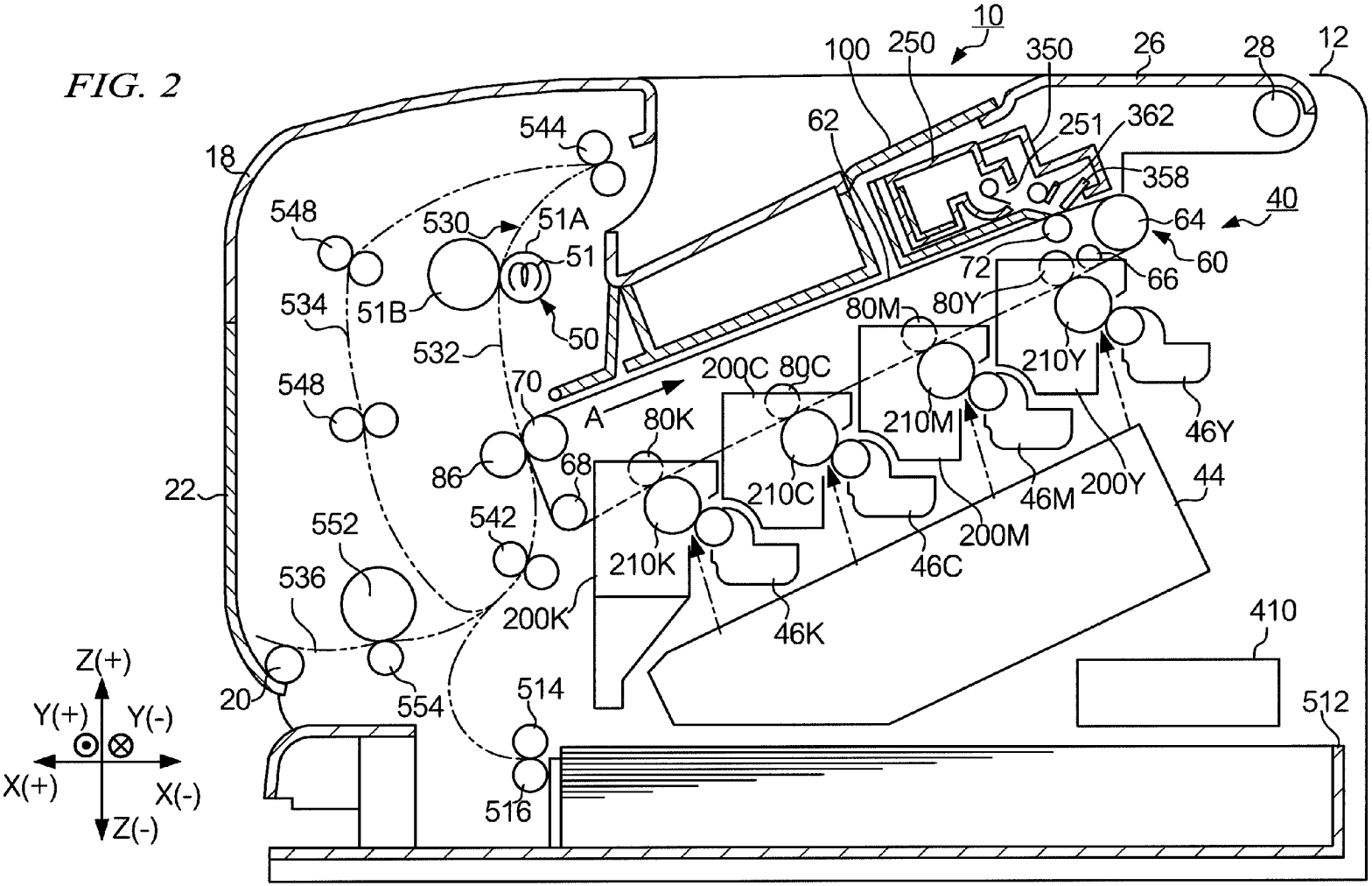
FIG. 2 is a schematic view of a cross-section of image-forming apparatus 10.
Figure 3:
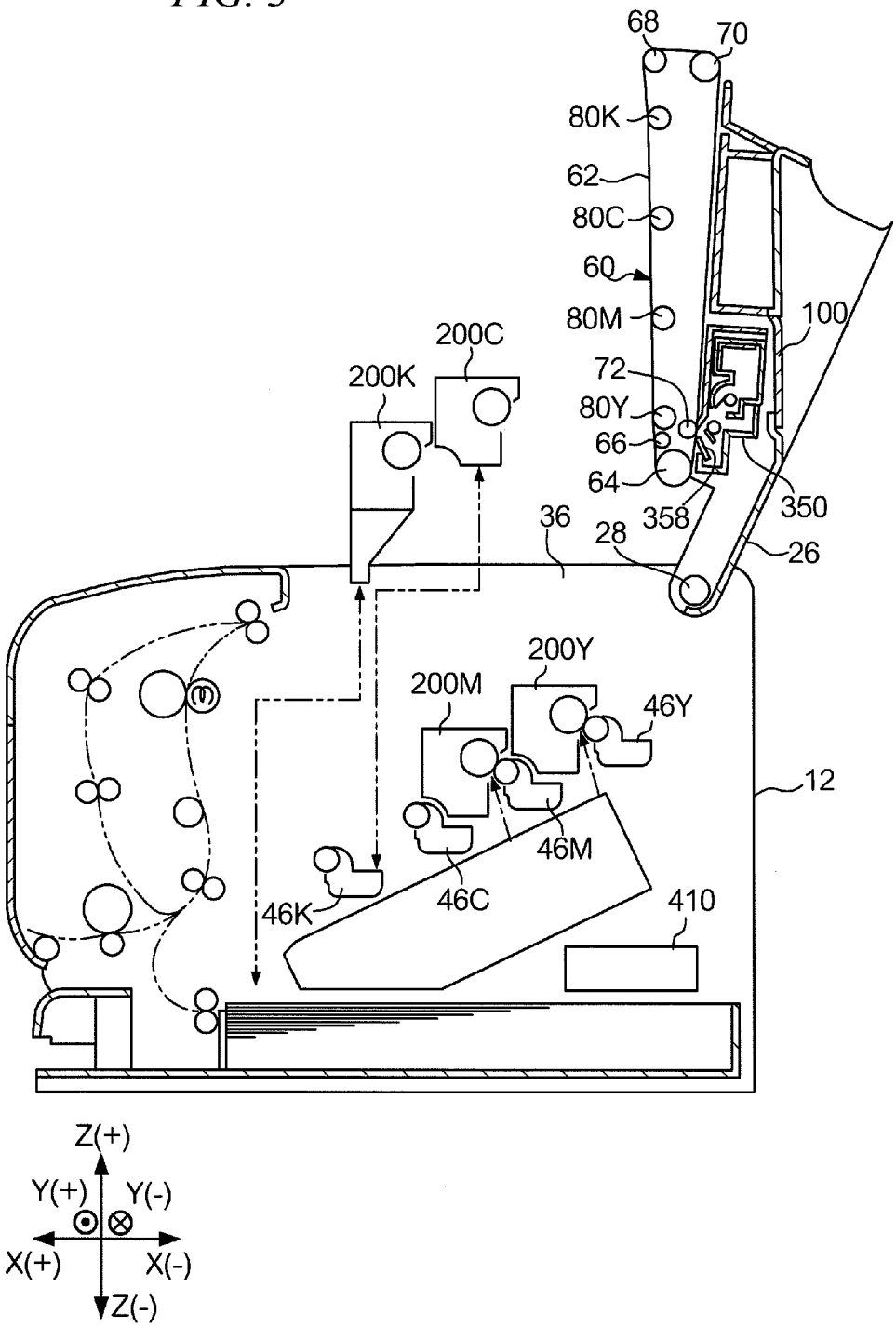
FIG. 3 is a schematic view of a cross-section of image-forming apparatus 10.

FIG. 1 shows an exterior of image-forming apparatus 10 according to the exemplary embodiment of the present invention. FIG. 2 and FIG. 3 are schematic views of a cross-section of image-forming apparatus 10. Image-forming apparatus 10 is an electrophotographic image-forming apparatus. Image-forming apparatus 10 forms an image on a recording medium, such as a paper and an OHP (Overhead Projector) sheet.

In the present description and drawings, directions are indicated using X-axis, Y-axis and Z-axis, which are perpendicular to each other. Specifically, a frontward/rearward direction is defined as X-axial direction, a rightward/leftward direction is defined as Y-axial direction, and an upward/downward direction is defined as Z-axial direction. Also, in the drawings, a frontward direction is indicated by arrow X, and a rearward direction by arrow (−X). A rightward direction is indicated by arrow Y, and a leftward direction by arrow (−Y). An upward direction is indicated by arrow Z, and a downward direction by arrow (−Z).

Image-forming apparatus 10 includes device body 12. Image-forming apparatus 10 also includes first openable member 26 and second openable member 18. Second openable member 18 can be opened forward pivoting on hinge 20. Second openable member 18 includes fourth openable member 22. Fourth openable member 22 can be opened forward even if second openable member 18 is closed. On second openable member 18, liquid crystal display 411 is disposed. Liquid crystal display 411 is an example of a display that displays information. Liquid crystal display 411 displays various messages under the control of controller 410, which is described later.

Figure 4A:
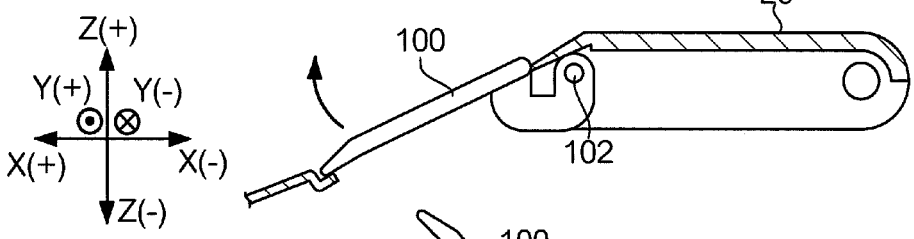
FIGS. 4A and 4B are schematic views of third openable member 100 as viewed from the right side.
Figure 4B:
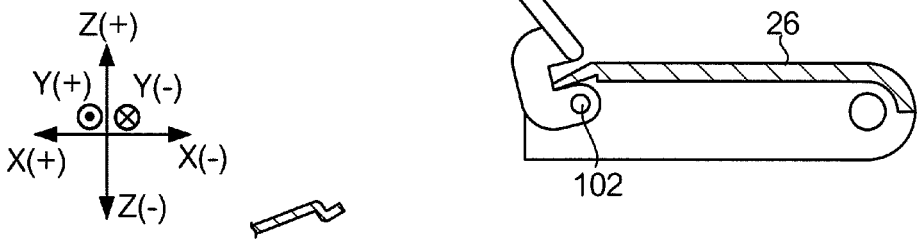

First openable member 26 can be opened upward pivoting on hinge 28 as shown in FIG. 3. First openable member 26 is opened when photosensitive unit 200Y, 200M, 200C, or 200K is attached to or detached from image-forming apparatus 10. First openable member 26 includes third openable member 100. FIG. 4A and FIG. 4B are schematic views of third openable member 100 as viewed from the right side. Third openable member 100 can be opened upward pivoting on hinge 102 as shown in FIG. 4B.

Next, description is made of an internal configuration of image-forming apparatus 10. Inside image-forming apparatus 10, controller 410 is disposed. Controller 410 includes a microcomputer to control components of image-forming apparatus 10. Controller 410 also includes an interface to communicate with an external computer device. Controller 410 communicates with the external computer device via the interface to acquire image data that represents an image. Controller 410 controls liquid crystal display 411 to display various messages on liquid crystal display 411.

Inside image-forming apparatus 10, image-forming unit 40 is disposed. Image-forming unit 40 includes photosensitive units 200Y, 200M, 200C, and 200K. In the present description and drawings, components related to an image of yellow are indicated by reference numerals with a letter "Y" appended. Components related to an image of magenta are indicated by reference numerals with a letter "M" appended. Components related to an image of cyan are indicated by reference numerals with a letter "C" appended. Components related to an image of black are indicated by reference numerals with a letter "K" appended. Components indicated by identical reference numerals with a letter "Y," "M," "C," or "K," have the same configuration, although related colors are different. Accordingly, in the following description, the appended letter is omitted, except where it is otherwise necessary to distinguish between these components.

Each of photosensitive units 200 includes photosensitive drum 210. Each of photosensitive units 200 also includes a charging unit that uniformly charges the surface of corresponding photosensitive drum 210, and a cleaning device that removes toner remaining on corresponding photosensitive drum 210, although these components are not shown.

Below photosensitive units 200, exposure device 44 is disposed. At the rear of each photosensitive unit 200, developing device 46 is disposed. Exposure device 44 is controlled by controller 410. Exposure device 44 irradiates photosensitive drums 210 on the basis of an image of image data that is acquired by controller 410, to form an electrostatic latent image on the surface of each photosensitive drum 210. Electrostatic latent images formed on the surfaces of photosensitive drums 210 are developed with toner supplied from developing devices 46Y, 46M, 46C, and 46K, respectively. Specifically, developing device 46Y develops an electrostatic latent image formed on photosensitive drum 210Y with toner of yellow. Developing device 46M develops an electrostatic latent image formed on photosensitive drum 210M with toner of magenta. Developing device 46C develops an electrostatic latent image formed on photosensitive drum 210C with toner of cyan. Developing device 46K develops an electrostatic latent image formed on photosensitive drum 210K with toner of black.

When first openable member 26 is closed, intermediate transfer unit 60 is located above photosensitive units 200. Intermediate transfer unit 60 includes endless shaped intermediate transfer belt 62. Intermediate transfer unit 60 also includes primary transfer rollers 80Y, 80M, 80C, and 80K. Primary transfer rollers 80 are an example of a first transfer unit that transfers a toner image onto an intermediate transfer belt. Intermediate transfer unit 60 also includes supporting rollers 64, 66, 68, 70, and 72. After toner images of yellow, magenta, cyan, and black are formed on photosensitive drums 210Y, 210M, 210C, and 210K, the toner images are transferred onto intermediate transfer belt 62 by primary transfer rollers 80Y, 80M, 80C, and 80K, respectively.

Intermediate transfer belt 62 is an example of an intermediate transfer medium onto which a toner image is transferred, and also is an example of a holder that holds toner. Intermediate transfer belt 62 is supported by supporting rollers 64, 66, 68, 70, and 72. Supporting roller 72 is caused to rotate by a motor (not shown). Upon rotation of supporting roller 72, intermediate transfer belt 62 is caused to rotate in a direction of arrow A shown in FIG. 2. Intermediate transfer unit 60 is attached to first openable member 26. Thus, when first openable member 26 is opened, intermediate transfer unit 60 moves together with first openable member 26 as shown in FIG. 3.

When first openable member 26 is closed, secondary transfer roller 86 faces supporting roller 70 via intermediate transfer belt 62. Secondary transfer roller 86 is an example of a second transfer unit that transfers a toner image formed on intermediate transfer belt 62 onto a recording medium. After a toner image of black, yellow, magenta, and cyan, is formed on intermediate transfer belt 62, the toner image is transferred onto a recording medium by secondary transfer roller 86 that is pressed against supporting roller 70.

The toner image transferred onto the recording medium is fixed by fixing device 50. Fixing device 50 includes heat roller 51A and pressure roller 51B. Heat roller 51A contains heating unit 51. Pressure roller 51B faces heat roller 51A. When the recording medium is conveyed and is held between heat roller 51A and pressure roller 51B, heat is applied to the recording medium by heat roller 51A, which is heated from heating unit 51; also, pressure is applied by pressure roller 51B. The toner image formed on the recording medium is fixed by this application of heat and pressure.

Recording mediums are stored in a layered fashion in storage container 512 that is located below exposure device 44. Each recording medium stored in storage container 512 is conveyed to conveyance path 532, conveyance path 534, and conveyance path 530 by plural rollers disposed inside image-forming apparatus 10.

Rollers 514 and 516 serve to send a recording medium stored in storage container 512 to a conveyance path. Roller 542 serves to send a recording medium, which has been conveyed from storage container 512, to secondary transfer roller 86. Roller 542 causes the recording medium to stop temporarily, and conveys the recording medium so that a toner image formed on intermediate transfer belt 62 is transferred onto the recording medium at a position where secondary transfer roller 86 is located.

Roller 544 serves to output a recording medium to the outside of image-forming apparatus 10. Roller 544 outputs the recording medium, on which a toner image is fixed by fixing device 50, to the outside of image-forming apparatus 10. However, if images are to be formed on both sides of the recording medium, roller 544 conveys the recording medium to roller 548 such that a front side, on which an image is firstly formed, faces fixing device 50. Roller 548 serves to convey to roller 542 a recording medium that has been sent from roller 544. After an image is formed on the front side, the recording medium is conveyed from roller 542 to secondary transfer roller 86. As a result, a reverse side of the recording medium faces intermediate transfer belt 62. Roller 522 and roller 554 serve to convey a recording medium to roller 542. When fourth openable member 22 is opened and a user feeds a recording medium to roller 552 and roller 554, roller 552 and roller 554 convey the recording medium to roller 542.

When first openable member 26 is closed, removing device 350 is located above intermediate transfer unit 60. Removing device 350 is an example of a removing unit that removes toner remaining on intermediate transfer belt 62 that is not transferred onto a recording medium passed between supporting roller 70 and secondary transfer roller 86. Removing device 350 is attached to first openable member 26. Thus, when first openable member 26 is opened, removing device 350 moves together with first openable member 26 as shown in FIG. 3.

Removing device 350 includes scraper 358. Scraper 358 serves as a member for scraping toner remaining on intermediate transfer belt 62. Scraper 358 contacts intermediate transfer belt 62, and has a width in a rightward/leftward direction greater than that of intermediate transfer belt 62. Removing device 350 also includes conveyance member 362. Conveyance member 362 serves to convey toner scraped by scraper 358. Conveyance member 362 is caused to rotate by a motor (not shown) to convey toner scraped by scraper 358 to collecting container 250.

The toner removed by removing device 350 is stored in collection container 250. Collection container 250 is an example of a container in which toner is stored. In the present exemplary embodiment, if third openable member 100 is opened, collection container 250 can be detached from or reattached to removing device 350 even if first openable member 26 is closed. At a time for replacement of collection container 250, a user of image-forming apparatus 10 removes collection container 250 from removing device 350, and attaches to removing device 350 empty collection container 250 in which no toner is contained.

Figure 5:
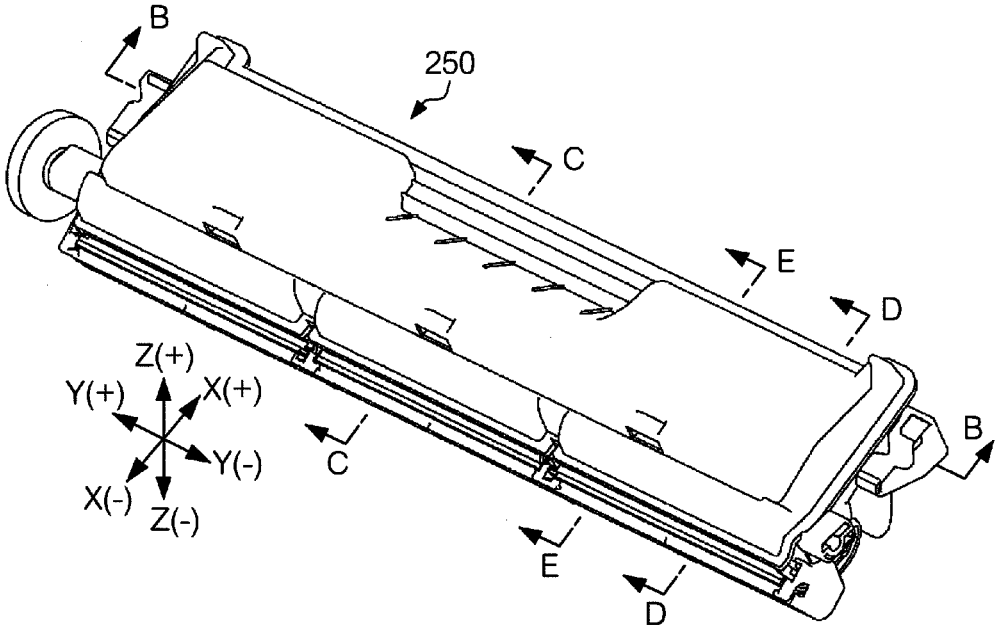
FIG. 5 shows an exterior of collection container 250.
Figure 6:
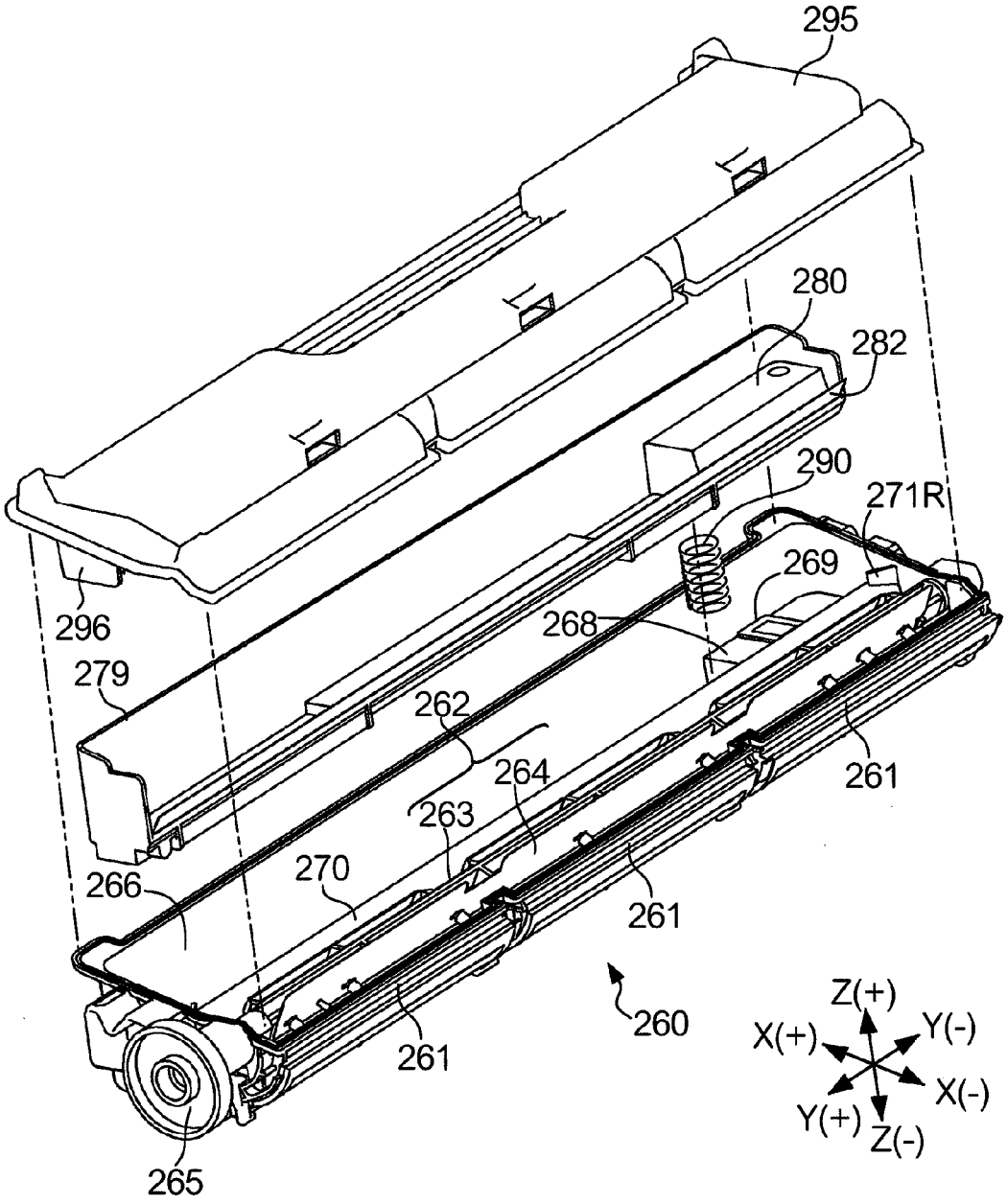
FIG. 6 is an exploded perspective view of collection container 250.

FIG. 5 shows an exterior of collection container 250. FIG. 6 is an exploded perspective view of collection container 250. Collection container 250 is composed of cover 295, toner container 279, spring 290, and body 260. Cover 295 is put on body 260 and toner container 279. In collection container 250, spring 290 is disposed between body 260 and toner container 279, and toner container 279 is placed in body 260. After toner container 279 is placed in body 260, cover 295 is put on body 260 and toner container 279 to seal the inside of collection container 250. Cover 295 has partition plate 296 that protrudes downward.

Body 260 has apertures 251 through which toner received from removing device 350 passes to the inside of body 260. Body 260 also includes shutters 261 for opening and closing apertures 251. When collection container 250 is removed from removing device 350, shutters 261 close apertures 251. On the other hand, when collection container 250 is attached to removing device 350, shutters 261 open apertures 251.

Figure 9:
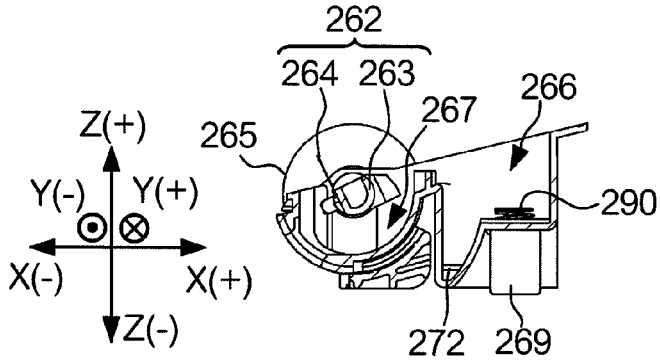
FIG. 9 is a cross-sectional view of collection container 250 taken along line A-A of FIG. 7.
Figure 7:
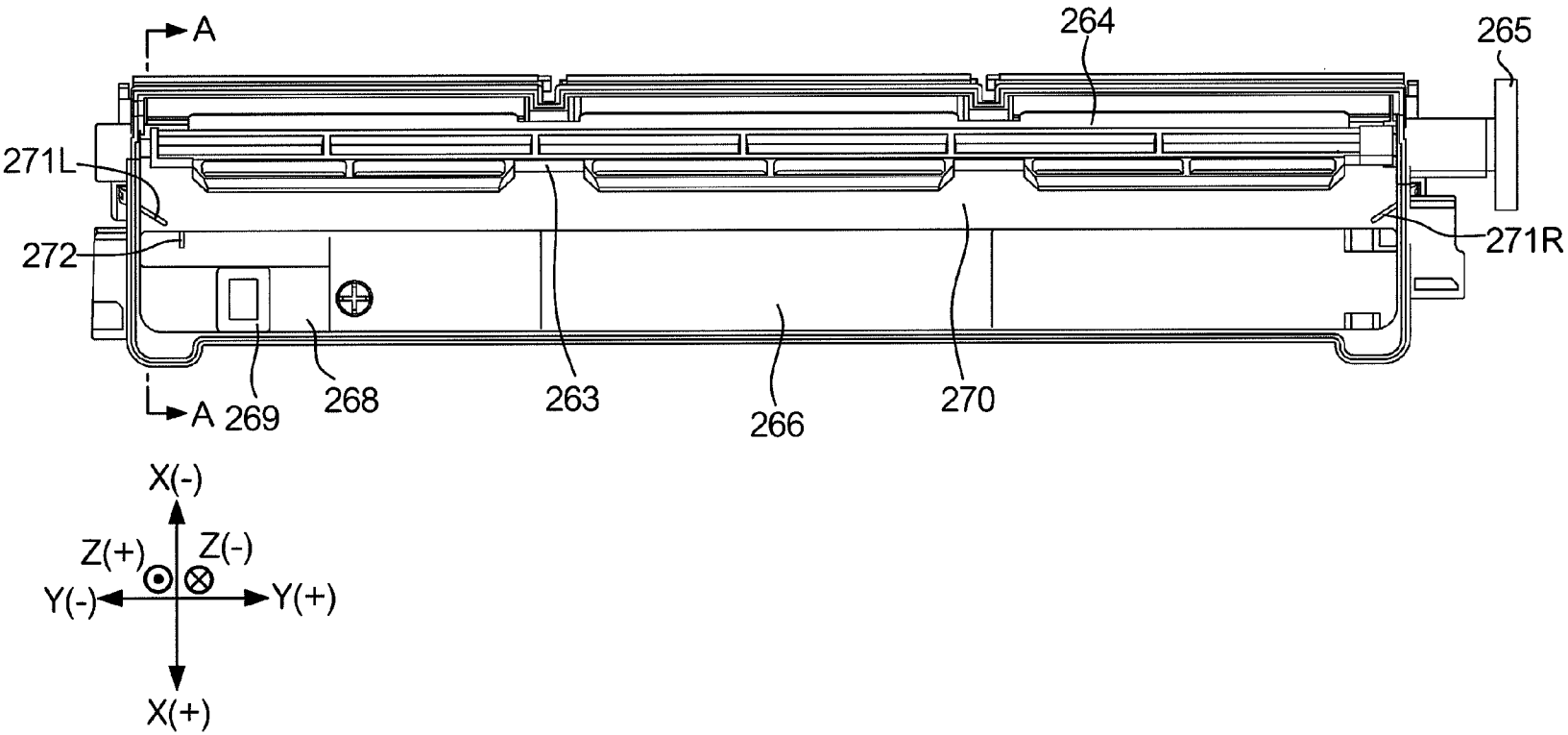
FIG. 7 is a top view of collection container 250 from which cover 295 and toner container 279 are removed.
Figure 8:
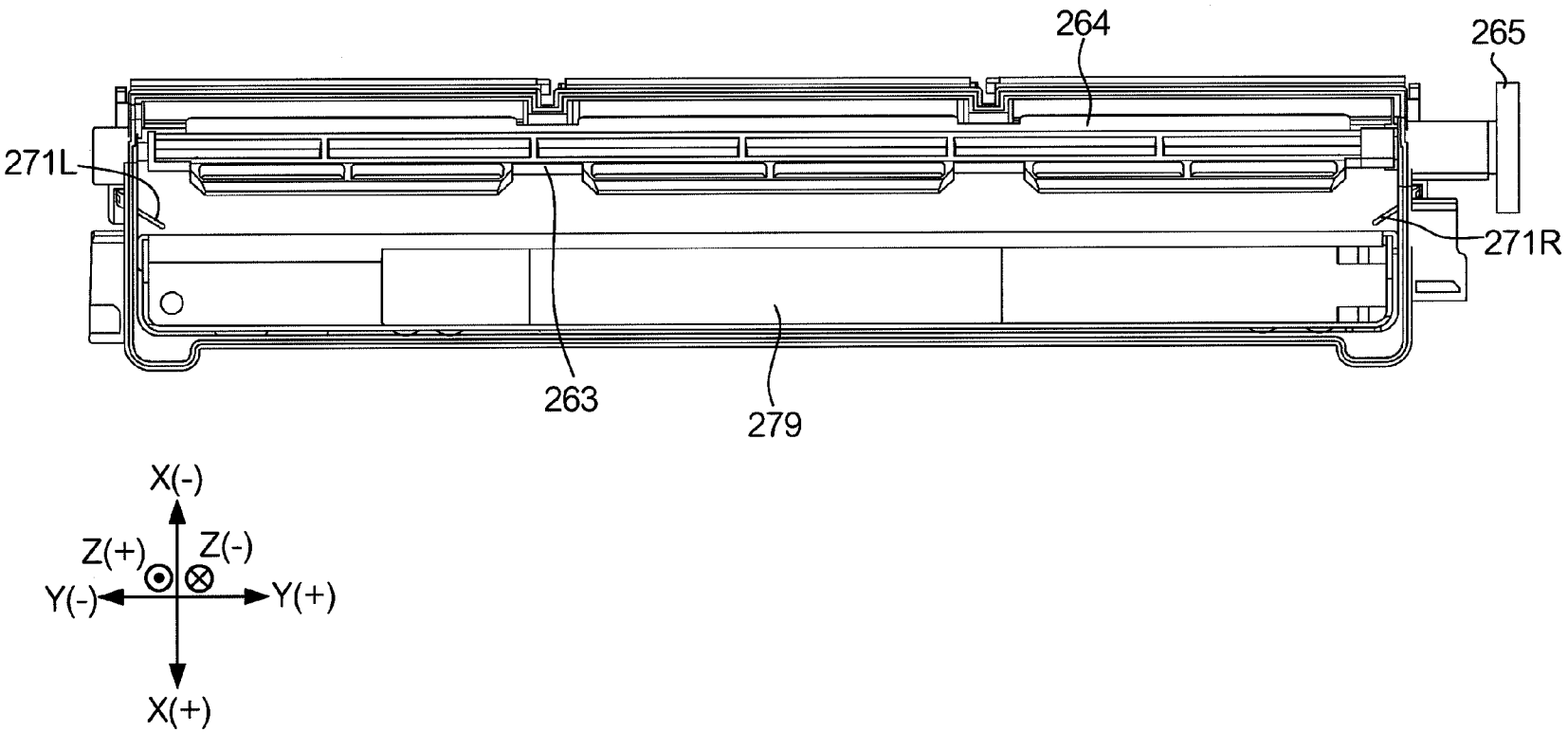
FIG. 8 is a top view of collection container 250 from which cover 295 is removed.

FIG. 7 is a top view of collection container 250 from which cover 295 and toner container 279 is removed. FIG. 8 is a top view of collection container 250 from which cover 295 is removed. FIG. 9 is a cross-sectional view of collection container 250 taken along line A-A of FIG. 7.

Body 260 includes first concave portion 267 in which toner that is sent from removing device 350 is stored, and second concave portion 266 in which toner container 279 is received. First concave portion 267 is an example of a first receiving unit in which a toner passed through aperture 251 is stored. Second concave portion 266 is an example of a second receiving unit in which toner container 279 is accommodated. First concave portion 267 and second concave portion 266 have a greater width in a rightward/leftward direction. First concave portion 267 is located at the rear side of second concave portion 266 in alignment with second concave portion 266.

Between a rear top of second concave portion 266 and a front top of first concave portion 267, passing portion 270 (an example of a passing area) is provided. Passing portion 270 extends from the rear top of second concave portion 266 to the front top of first concave portion 267. When toner is sent from first concave portion 267 to second concave portion 266, the toner passes through the surface of passing portion 270.

First concave portion 267 is an arc-shape in a cross-section as viewed in the rightward/leftward direction. Second concave portion 266 has a raised portion that extends in the rightward/leftward direction as viewed in the frontward/rearward direction. Raised portion 268 is located on the left side of second concave portion 266. Raised portion 268 is higher than the lowermost surface of second concave portion 266. In raised portion 268, a hole that penetrates to the undersurface of toner container 279 is provided. To the hole, transmitting portion 269, which is made of transmissive synthetic resin, is fitted. Transmitting portion 269 is formed in a hollow angular tube one end of which is closed. Light passes through transmitting portion 269. On an opening side of transmitting portion 269, a protruding flange-shaped portion is provided. The flange-shaped portion is adhered to raised portion 268, whereby transmitting portion 269 is fixed to raised portion 268.

Body 260 includes conveyance member 262. Conveyance member 262 is disposed along the greater width of first concave portion 267. Conveyance member 262 is composed of rotating shaft 263 and synthetic resin sheet 264. Synthetic resin sheet 264 is attached to rotating shaft 263 along the axial direction of rotating shaft 263. Ends of rotating shaft 263 are inserted into holes that are respectively formed on the right side and the left side of body 260, whereby rotating shaft 263 is supported. One end of rotating shaft 263 is exposed to the outside through one of the holes. To the exposed end, gear 265 is attached. Gear 265 is caused to rotate by a motor (not shown). Upon rotation of gear 265, conveyance member 262 rotates inside collection container 250, whereby toner is sent to toner container 279 by sheet 264. In other words, conveyance member 262 is an example of a conveyance member that conveys toner in a direction across a direction in which a first concave portion extends.

Body 260 includes plate 271L and plate 271R. Plate 271L guides toner that has been conveyed from second concave portion 266 to the left end of passing portion 270, rightward from the left end. Plate 271R guides toner that has been conveyed from second concave portion 266 to the right end of passing portion 270, leftward from the right end. Plate 271L and plate 271R are provided on passing portion 270. Plate 271L and plate 271R protrude from passing portion 270 in the upward direction. Plate 271L also protrudes from a surface of a left end wall of body 260 in a diagonally forward right direction as viewed from above. Plate 271R protrudes from a surface of a right end wall of body 260 in a diagonally forward left direction as viewed from above. By employing this configuration, when toner is conveyed from second concave portion 266 to passing portion 270 by conveyance member 262, the toner is sent by plate 271L and 271R to the center of passing portion 270 in the rightward/leftward direction. In other words, plate 271L and plate 271R are an example of a guide portion that guides a toner located at both ends on the surface of passing portion 270 to the center of passing portion 270 in the rightward/leftward direction. In the drawings, each of plate 271R and plate 271L has a plate shape as viewed from above, but it may be of a triangular shape that protrudes from either end of body 260 to the center in the rightward/leftward direction as viewed from above.

Body 260 also includes plate 272 on second concave portion 266. Plate 272 protrudes from the bottom of second concave portion 266 in the upward direction. Plate 272 extends in the frontward/rearward direction as viewed from above. Plate 272 partitions the bottom of second concave portion 266. Plate 272 prevents toner from moving to the center of second concave portion 266 if toner enters the left end of second concave portion 266 from a gap between toner container 279 and second concave portion 266.

Toner container 279 is a container in which toner that has been conveyed by conveyance member 262 is collected. In toner container 279, a front sidewall is higher than a rear sidewall. The bottom of toner container 279 has a raised portion to enable it to fit on second concave portion 266. Raised portion 280 is provided on the left side of the bottom of toner container 279. When toner container 279 is accommodated in second concave portion 266, raised portion 280 is located above raised portion 268. On the under side of raised portion 280, protrusion 281 that protrudes in the downward direction is provided. When toner container 279 is accommodated in second concave portion 266, protrusion 281 moves into transmitting portion 269.

On the rear side of toner container 279, synthetic resin sheet 282 is attached along the rightward/leftward direction. When toner container 279 is accommodated in second concave portion 266, sheet 282 deflects and contacts the rear wall of second concave portion 266. In contact with the rear wall of second concave portion 266, sheet 282 prevents toner from entering a gap between the rear wall of second concave portion 266 and toner container 279.

Spring 290 is a coiled spring disposed between body 260 and toner container 279. Spring 290 is an example of a supporting member that supports toner container 279. Spring 290 is also an example of an elastic body that has resistance to a weight of toner container 279. Spring 290 is disposed on second concave portion 266 to support toner container 279 from underneath. Spring 290 has a height greater than a height from the bottom of second concave portion 266 to the top of raised portion 280. Spring 290 supports toner container 279 at non-central position in the rightward/leftward direction. In the present exemplary embodiment, spring 290 supports toner container 279 at the right side of raised portion 268.

Figure 10:
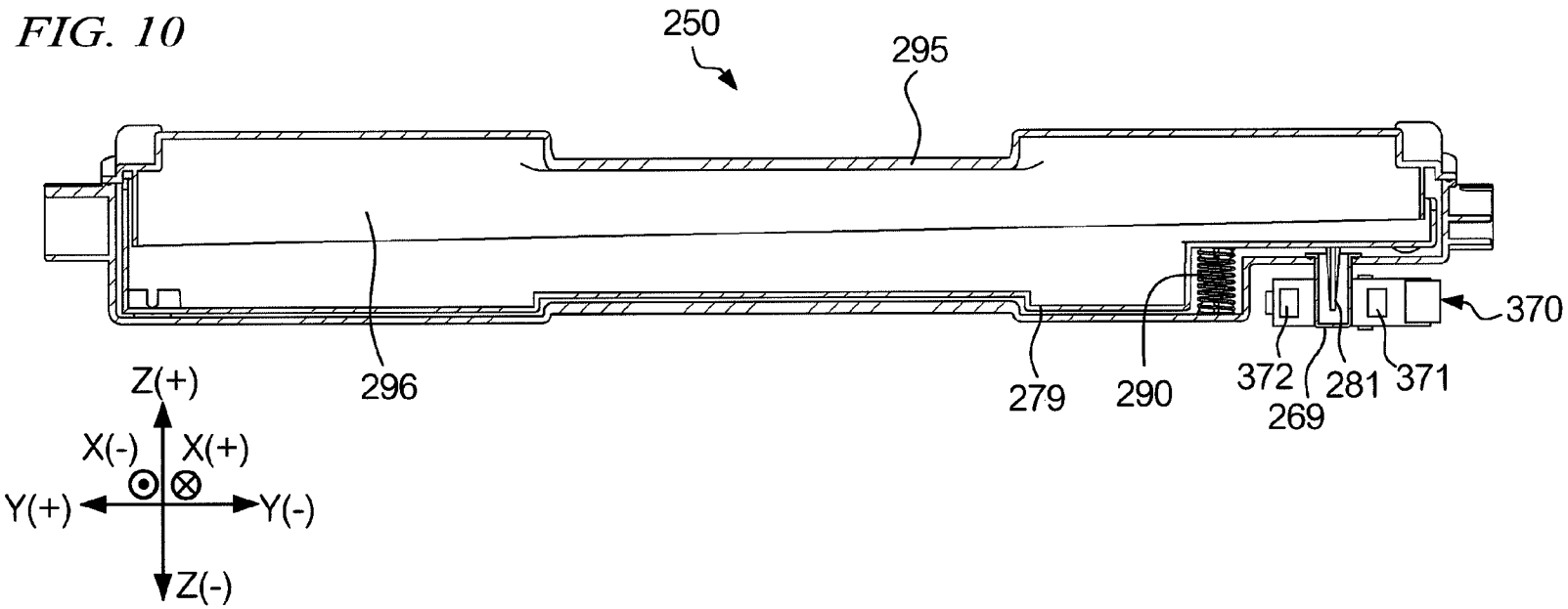
FIG. 10 is a cross-sectional view of collection container 250 taken along line B-B of FIG. 5.
Figure 11:
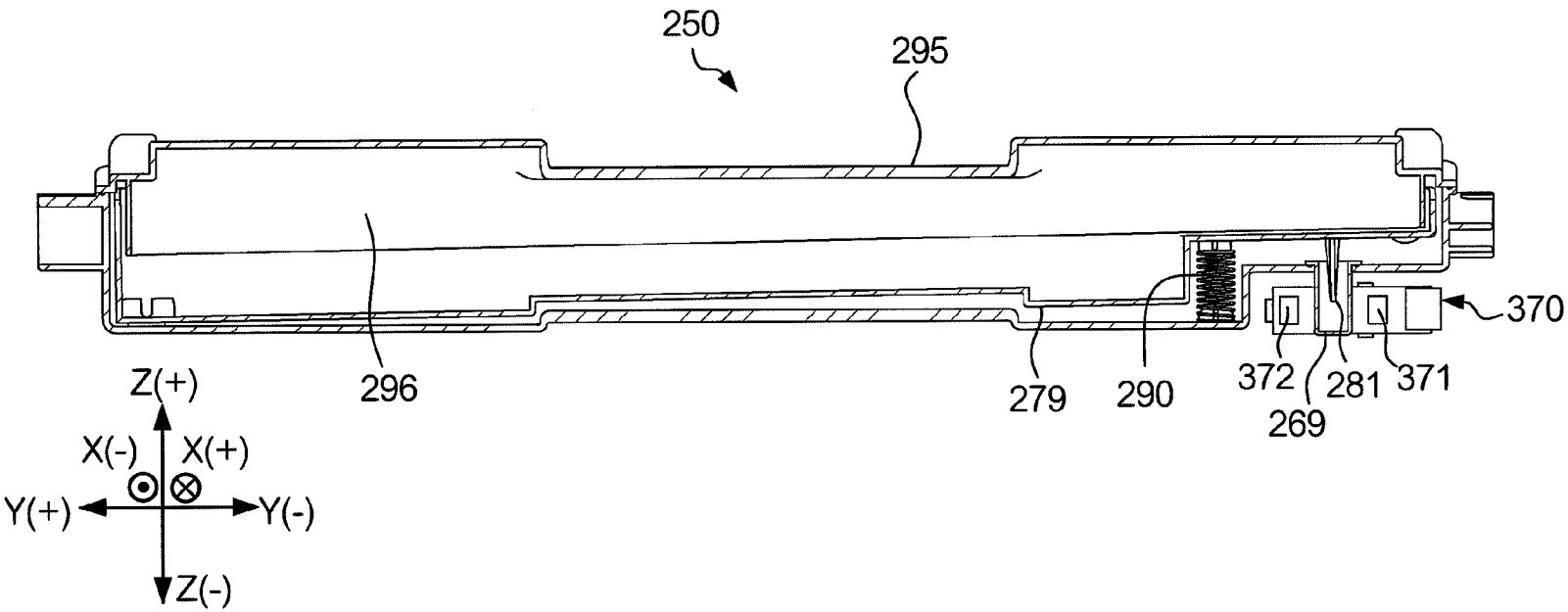
FIG. 11 is a cross-sectional view of collection container 250 taken along line B-B of FIG. 5.
Figure 12:
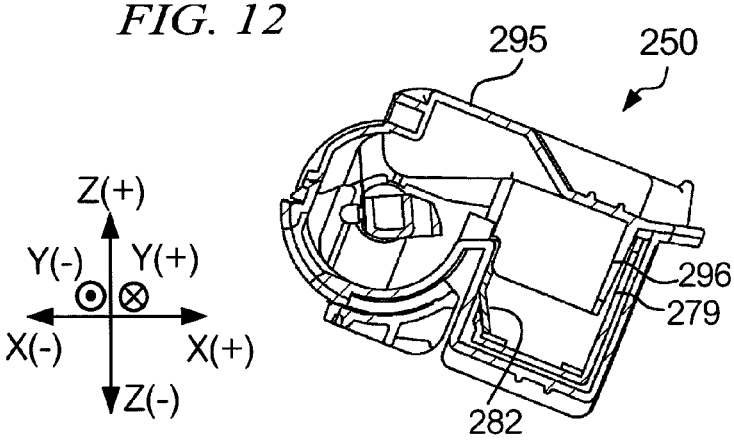
FIG. 12 is a cross-sectional view of collection container 250 taken along line C-C of FIG. 5.
Figure 13:
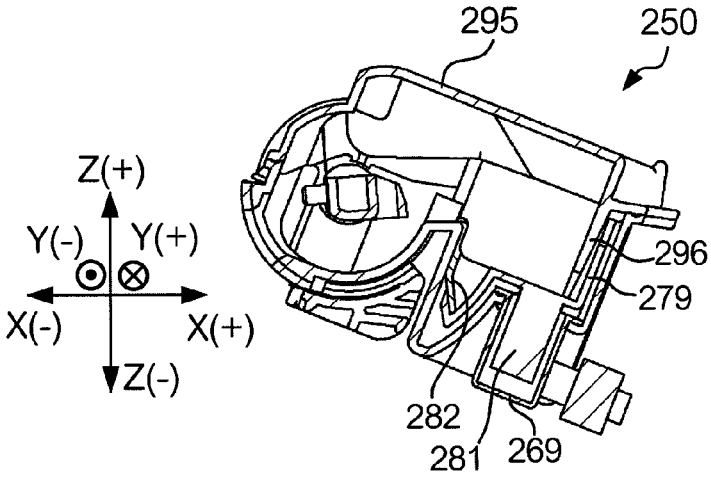
FIG. 13 is a cross-sectional view of collection container 250 taken along line D-D of FIG. 5.
Figure 14:
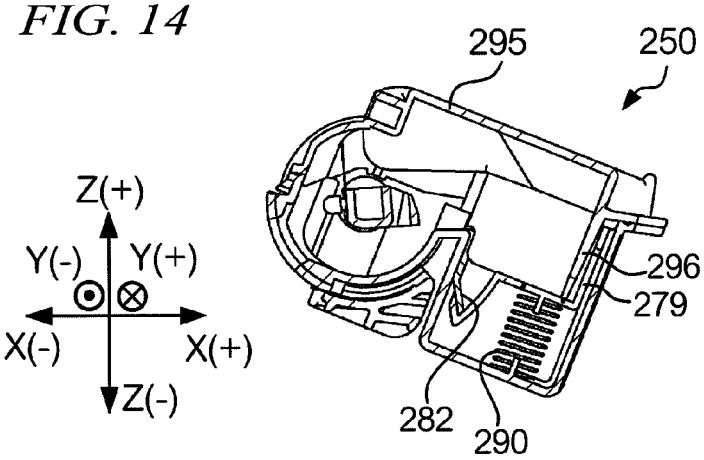
FIG. 14 is a cross-sectional view of collection container 250 taken along line E-E of FIG. 5.

Next, FIG. 10 and FIG. 11 are cross-sectional views of collection container 250 taken along line B-B of FIG. 5. FIG. 12 is a cross-sectional view of collection container 250 taken along line C-C of FIG. 5. FIG. 13 is a cross-sectional view of collection container 250 taken along line D-D of FIG. 5. FIG. 14 is a cross-sectional view of collection container 250 taken along line E-E of FIG. 5. FIG. 11 shows empty toner container 279. On the other hand, FIG. 10, and FIG. 12 to FIG. 14 show toner container 279 in which toner is stored. However, in FIG. 12 to FIG. 14 toner is not shown.

As shown in FIG. 10 to FIG. 14, when cover 295 is attached to body 260, partition plate 296 enters toner container 279. When partition plate 296 enters toner container 279, a front sidewall of toner container 279 is held between partition plate 296 and a rear inner surface of second concave portion 266, where partition plate 296 contacts the inner side of toner container 279. Contact between partition plate 296 and the inner side of toner container 279 prevents toner from entering a gap between a wall surface of second concave portion 266 and toner container 279.

In FIG. 10 and FIG. 11, sensor unit 370, which is provided in image-forming apparatus 10, is shown. Sensor unit 370 includes light-emitting unit 371 and light-receiving unit 372. Light-emitting unit 371 includes a light-emitting diode. When light is emitted from light-emitting unit 371 by the light-emitting diode, the light passes through transmitting portion 269, and is received at light-receiving unit 372. Light-receiving unit 372 includes a photodiode. When the photodiode receives light, light-receiving unit 372 outputs to controller 410 a signal that represents receipt of the light.

Operation in Exemplary Embodiment

Next, description is made of an operation of collection container 250 in the present exemplary embodiment. Immediately after a user replaces collection container 250, toner container 279 is located at a position in which a weight of empty toner container 279 and an elastic force of spring 290 are balanced as shown in FIG. 11. Spring 290 is located at the left side of the center of second concave portion 266 in the rightward/leftward direction. Thus, toner container 279 contacts the bottom of second concave portion 266 at the right undersurface of toner container 279. As a result, toner container 279 is inclined upward to the right as shown in FIG. 11 as viewed from the rear side.

In a state shown in FIG. 11, due to an inclination of toner container 279, protrusion 281 does not reach a position between light-emitting unit 371 and light-receiving unit 372. Therefore, light emitted from light-emitting unit 371 is not intercepted. The light emitted from light-emitting unit 371 passes through transmitting portion 269, and the light is received by light-receiving unit 372. Upon receipt of the light, light-receiving unit 372 outputs to controller 410 a signal that represents the receipt of the light. While receiving this signal, controller 410 determines that collection container 250 does not need to be replaced.

After this, in image-forming apparatus 10, when an image is formed onto a recording medium, toner remaining on intermediate transfer belt 62 is removed by removing device 350. Namely, the toner is scraped by scraper 358. The scraped toner is conveyed to collection container 250, and moves into first concave portion 267. After moving into first concave portion 267, the toner is sent to passing portion 270 by conveyance member 262, and moves into toner container 279. When the toner moves into toner container 279 via the surface of passing portion 270, spring 290 is compressed depending due to a total weight of toner contained in toner container 279, whereby toner container 279 moves downward. When toner container 279 moves downward, protrusion 281 also moves downward inside transmitting portion 269.

In addition, plate 271L is provided at the left end of passing portion 270, and plate 271R is provided at the right end of passing portion 270; thus after toner is conveyed from second concave portion 266 to passing portion 270 by conveyance member 262, the toner is sent to the center of passing portion 270 in the rightward/leftward direction by plates 271L and 271R. In this case, toner is not directly sent to a space between right and left outer surfaces of toner container 279, and right and left ends of second concave portion 266. In other words, plates 271L and 271R prevent toner from entering a gap between toner container 279 and second concave portion 266.

Further, toner container 279 includes sheet 282. Sheet 282 contacts the rear wall of second concave portion 266 when toner container 279 is attached to second concave portion 266, to prevent toner from entering into a space between toner container 279 and second concave portion 266 through a gap between the rear wall of second concave portion 266 and toner container 279. Since toner is prevented from entering the space between toner container 279 and second concave portion 266, toner is also prevented from entering transmitting portion 269. The right end of sheet 282 may be located on the right side of the end of plate 271R. The left end of sheet 282 may be located on the left side of the end of plate 271L.

When an amount of toner stored in toner container 279 increases, protrusion 281 moves downward inside transmitting portion 269 to an extent determined by a total weight of stored toner, and protrusion 281 intercepts light, which is emitted from light emitting unit 371 and is to be received by light receiving unit 372. Upon interception of the light, a signal that represents a receipt of the light is no longer output from light-receiving unit 372. In this case, controller 410 cannot acquire a signal that has been output from light-receiving unit 372, and determines that collection container 250 should be replaced. Upon determining that collection container 250 should be replaced, controller 410 displays on liquid crystal display 411 a message, thus prompting a user to replace collection container 250.

In the present exemplary embodiment, protrusion 281 moves downward if toner is stored on either the right or the left side of toner container 279. Therefore, it is possible to prompt a user to replace collection container 250 in a timely manner, as compared with a configuration in which a time for replacement of a collection container is determined using toner that is stored in one part on the right or left side of toner container 279.

In addition, in the present exemplary embodiment, since toner is prevented from entering a gap between toner container 279 and second concave portion 266, toner is also prevented from entering transmitting portion 269. In this case, light to be incident on light receiving unit 372 is not intercepted by toner. As a result, it is possible to prompt a user to replace collection container 250 in a timely manner.

Modification

The foregoing description is made of the exemplary embodiment of the prevent invention, but the present invention is not limited to the exemplary embodiment described above. The present invention may be practiced in various other embodiments. For example, the foregoing exemplary embodiment may be modified as described below. Also, the foregoing exemplary embodiment and the following modifications may be combined with each other.

In the foregoing exemplary embodiment, body 260 includes plate 271L and plate 271R, but body 260 need not include plate 271L and plate 271R.

In the foregoing exemplary embodiment, body 260 includes plates 272, but body 260 need not include plate 272.

In the foregoing exemplary embodiment, toner container 279 includes sheet 282, but toner container 279 need not include sheet 282.

In the foregoing exemplary embodiment, spring 290 is a coiled spring, but a spring that supports toner container 279 may be a spring other than the coiled spring. In addition, in the present invention, a supporting member that supports toner container 279 is not limited to a spring if it is an elastic member.

In the foregoing exemplary embodiment, transmitting portion 269 is fitted to the hole of second concave portion 266, but transmitting portion 269 need not be fitted to the hole.

In the foregoing exemplary embodiment, light-receiving unit 372 includes a photodiode, but light-receiving unit 372 may include a cadmium sulfide (CdS) cell instead of the photodiode. In a configuration with the CdS cell, as protrusion 281 moves downward, a change is made in an amount of light that is emitted from light emitting unit 371 and is to be received at the CdS cell, where a resistance of the CdS cell is also changed. Controller 410 may measure the resistance of the CdS cell to measure an amount of downward movement of toner container 279. Controller 410 may change a message to be displayed on the liquid crystal display 411 based on the measured amount of downward movement.

In body 260, ribs may be provided on rear and front inner surfaces of second concave portion 266 along the upward/downward direction, to hold between the ribs toner container 279 that is accommodated in second concave portion 266. The ribs may be located at a position between transmitting portion 269 and the left end of second concave portion 266 as viewed from above. According to this configuration, the ribs prevent toner from moving to the center of second concave portion 266 even if toner enters the left end of second concave portion 266 from a gap between toner container 279 and second concave portion 266.

In addition, when ribs are provided at the rear and front inner surfaces of second concave portion 266 in body 260, the ribs extending in the rightward/leftward direction may be provided.

In the foregoing exemplary embodiment, only one spring 290 is provided, but an additional spring 290 may be disposed on the right side of the center of second concave portion 266 in the rightward/leftward direction, to provide support for toner container 279 by two springs.

In the foregoing exemplary embodiment, collection container 250 stores toner that is removed from intermediate transfer belt 62, but toner stored in collection container 250 is not limited to toner that is removed from intermediate transfer belt 62.

In an electrophotographic image-forming apparatus, toner remaining on a cylindrical photosensitive drum, on which an electrostatic latent image is formed, is removed and collected; however, toner removed from a photosensitive drum, which serves as a holder for holding toner, may be conveyed to collection container 250, and the conveyed toner may be stored in collection container 250.

In an electrophotographic image-forming apparatus, toner may adhere to a belt for conveying to a photosensitive drum a sheet, on which an image is to be formed. Some image-forming apparatuses remove toner adhering to a belt, which serves as a holder for holding toner. In this case, the removed toner may be conveyed to collection container 250, and be stored in collection container 250.

In other words, collection container 250 according to the present exemplary embodiment may store unnecessary toner that is not transferred onto a sheet and is collected from a component other than an intermediate transfer belt.

In the foregoing exemplary embodiment, toner removed from intermediate transfer belt 62, which serves as a holder, is conveyed in a direction that intersects with a width direction of intermediate transfer belt 62, and is stored in collection container 250; however the direction in which toner that is removed from intermediate transfer belt 62 is conveyed is not limited to the direction described in the exemplary embodiment.

For example, toner removed from intermediate transfer belt 62 may be conveyed in the width direction of intermediate transfer belt 62, and the toner may be sent to collection container 250 that is located at the send destination.

Figure 15:
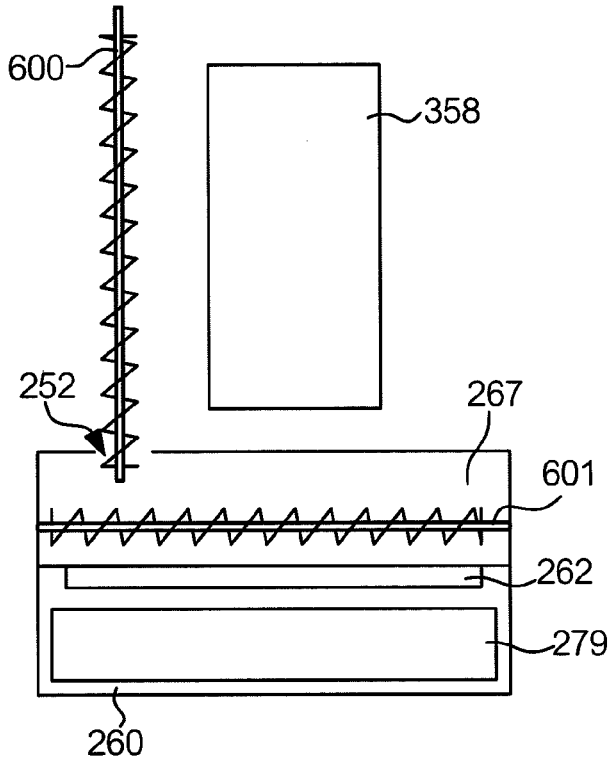
FIG. 15 schematically shows a modification of the present invention.

FIG. 15 schematically shows this configuration. In FIG. 15, cover 295 of collection container 250 is not shown. In FIG. 15, the inside of collection container 250 is schematically shown. In this configuration, conveyance member 600 for conveying toner removed from intermediate transfer belt 62 by scraper 358 is located above scraper 358. Toner removed from intermediate transfer belt 62 is sent to collection container 250 by rotation of spiral conveyance member 600.

On collection container 250, aperture 252 is provided through which toner conveyed by conveyance member 600 passes. The toner conveyed by conveyance member 600 moves into collection container 250 through aperture 252. In first concave portion 267 of collection container 250, spiral conveyance member 601 may be provided to convey toner conveyed by conveyance member 600 in the longer direction of collection container 250.

According to this configuration, toner moved through aperture 252 into first concave portion 267 is conveyed in the longer direction of first concave portion 267. Then the toner spreads in the longer direction of first concave portion 267, and the toner is sent to toner container 279 by rotation of conveyance member 262. According to this configuration as well, collection container 250 can store toner that is no longer needed.

In the configuration shown in FIG. 15, toner conveyed by conveyance member 600 may fall in the vertical direction at the end of conveyance member 600. In this configuration, the fallen toner moves into collection container 250.

In the foregoing exemplary embodiment, spring 290 supports toner container 279, but toner container 279 may be hung on spring 290 from cover 295. According to this configuration, toner container 279 moves downward as an increasing amount of toner is stored in toner container 279, and protrusion 281 also moves downward. Accordingly, it is possible to detect the time for replacement of collection container 250 in a manner similar to that of the foregoing exemplary embodiment.

In the foregoing exemplary embodiment, ends of toner container 279 in the longer direction contact second concave portion 266 at the undersurface of toner container 279. However, supporting member 800 that protrudes from body 260 may support the center of the undersurface of toner container 279 in the longer direction, and either one of the ends of toner container 279 may be supported by spring 290, or may be hung on spring 290.

Figure 16:
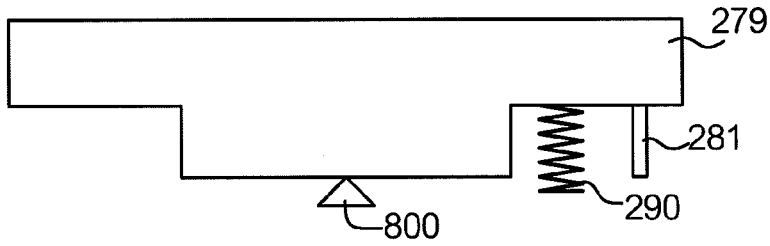
FIG. 16 schematically shows a modification of the present invention.

FIG. 16 schematically shows an example of a configuration in this modification. In this configuration, when an amount of toner stored in toner container 279 increases, a protrusion 281 side moves downward against an elastic force of spring 290. Accordingly, protrusion 281 also moves downward, thus it is possible to detect a time for replacement of collection container 250 by light-emitting unit 371 and light-receiving unit 372 in a manner similar to that of the foregoing exemplary embodiment.

In this configuration, protrusion 281 may be provided on a side opposite to spring 290 via the center of toner container 279. In this case, when protrusion 281 intercepts light that is emitted from light-emitting unit 371, controller 100 determines that toner does not need to be replaced. On the other hand, if a spring 290 side moves downward caused by a weight of toner, and a protrusion 281 side moves upward, protrusion 281 does not intercept light that is emitted from light-emitting unit 371. When light-receiving unit 372 detects the light, controller 100 may determine collection container 250 should be replaced.

In the configuration shown in FIG. 16 as well, either one of the ends of toner container 279 may be hung on spring 290.

In the foregoing exemplary embodiment, protrusion 281 provided on the undersurface of toner container 279 intercepts light that is to be incident on light-receiving unit 372; however, a configuration for interception of light that is to be incident on light-receiving unit 372 is not limited to the configuration described in the foregoing exemplary embodiment. For example, a configuration shown in a schematic view of FIG. 17 may be employed.

Figure 17:
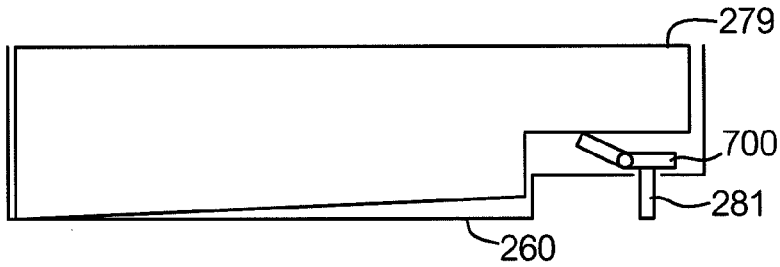
FIG. 17 schematically shows a modification of the present invention.

In FIG. 17, moving member 700 is composed of a shaft on which two plate members are combined inclined relative to each other. On one plate member, protrusion 281 is provided. The other plate member, on which protrusion 281 is not provided, is, for example, supported by a torsion spring that is provided on the shaft. The other plate member supports toner container 279 from underneath.

In this configuration, when toner container 279 moves downward caused by a weight of toner stored in toner container 279, moving member 700 rotates against an elastic force of the torsion spring, and protrusion 281 moves upward. When protrusion 281 moves upward, protrusion 281 does not intercept light that is emitted from light-emitting unit 371. When light-receiving unit 372 detects the light, controller 100 may determine that collection container 250 should be replaced.

In the configuration in which moving member 700 is used, when toner container 279 moves downward, protrusion 281 may also move downward. In this case, if protrusion 281 intercepts light that is emitted from light-emitting unit 371, and light-receiving unit 372 does not receive the light, controller 100 may determine that collection container 250 should be replaced.

In a configuration in which the center of the undersurface of toner container 279 is supported, the torsion spring may support the center, and either one of ends of toner container 279 may move downward caused by a weight of toner.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments have been chosen and described so that the principles of the invention and its practical applications are best explained, thereby enabling others skilled in the art to understand the invention for use with various embodiments and with various modifications as suited to a particular use contemplated. It is intended that the scope of the invention be defined by the following claims and their equivalents.

What is claimed is:

1. A collection container comprising:

a first receiving unit that receives toner removed from a toner holder, via an aperture;

a conveyance member that is provided in the first receiving unit to convey the received toner in a direction across a first direction in which the first receiving unit extends;

a toner container that has a width extending in the first direction to receive and store the toner conveyed by the conveyance member across the width;

an elastic body that supports the toner container against a weight of the toner container so that at least one end of the toner container is movable within a range greater than that of another part of the toner container; and a moving member that moves in accordance with a movement of one end of the toner container, when the elastic body elastically deformed caused by an increase in an amount of toner stored in the toner container;

a second receiving unit that is provided along the first receiving unit, and receives the toner container; and a sheet that is provided on the toner container on the first receiving unit side, and that contacts an inner surface of the second receiving unit when the toner container is accommodated in the second receiving unit, wherein when the toner container is accommodated in the second receiving unit, a top of the toner container on a first receiving unit side is located at a position lower than a top of the second receiving unit on a first receiving unit side.

2. A collection container comprising:

a first receiving unit that receives toner removed from a toner holder via an aperture;

a conveyance member that is provided in the first receiving unit to convey the received toner in a direction across a first direction in which the first receiving unit extends;

a toner container that has a width extending in the first direction to receive and store the toner conveyed by the conveyance member across the width;

an elastic body that supports the toner container against a weight of the toner container so that at least one end of the toner container is movable within a range greater than that of another part of the toner container;

a moving member that moves in accordance with a movement of one end of the toner container, when the elastic body elastically deformed caused by an increase in an amount of toner stored in the toner container;

a second receiving unit that is provided along the first receiving unit and receives the toner container; and a passing area that extends from a top of the first receiving unit on a second receiving unit side to a top of the second receiving unit on a first receiving unit side, to pass the toner conveyed by the conveyance member to the second receiving unit; and a plurality of guide portions respectively provided on each end of the passing area in the first direction, that protrude from a surface of the passing area to guide the toner to a center of the passing area.

3. The collection container according to claim 1, further comprising:

a passing area that extends from the top of the first receiving unit on the second receiving unit side to the top of the second receiving unit on the first receiving unit side, to pass the toner conveyed by the conveyance member to the second receiving unit; and a plurality of guide portions respectively provided on each end of the passing area in the first direction, that protrudes from a surface of the passing area to guide the toner to a center of the passing area.

4. The collection container according to claim 3, wherein the sheet has a length greater than a distance from one guide portion to another guide portion.

5. A collection container comprising:

a first receiving unit that receives toner removed from a toner holder, via an aperture;

a conveyance member that is provided in the first receiving unit to convey the received toner in a direction across a first direction in which the first receiving unit extends;

a toner container that has a width extending in the first direction to receive and store the toner conveyed by the conveyance member across the width;

an elastic body that supports the toner container against a weight of the toner container so that at least one end of the toner container is movable within a range greater than that of another part of the toner container;

a moving member that moves in accordance with a movement of one end of the toner container, when the elastic body elastically deformed caused by an increase in an amount of toner stored in the toner container;

a second receiving unit that is provided along the first receiving unit and receives the toner container; and a plate member that protrudes upward from a bottom of the second receiving unit to partition the bottom of the second receiving unit.

6. A collection container comprising:

a first receiving unit that receives toner removed from a toner holder, via an aperture;

a conveyance member that is provided in the first receiving unit to convey the received toner in a direction across a first direction in which the first receiving unit extends;

a toner container that has a width extending in the first direction to receive and store the toner conveyed by the conveyance member across the width;

an elastic body that supports the toner container against a weight of the toner container so that at least one end of the toner container is movable within a range greater than that of another part of the toner container;

a moving member that moves in accordance with a movement of one end of the toner container, when the elastic body elastically deformed caused by an increase in an amount of toner stored in the toner container; and a second receiving unit that is provided along the first receiving unit and receives the toner container, wherein the second receiving unit includes a plurality of ribs, each rib being located on either of surfaces facing side surfaces of the toner container, to hold the toner container between a rib located on one surface and a rib located on another surface that faces the one surface.

7. The collection container according to claim 1, wherein:

the moving member is a protruding portion provided on the toner container; and the moving member moves together with the toner container.

8. An image-forming apparatus comprising:

a collection container that includes:

a first receiving unit that receives toner removed from a toner holder by a removing member, via an aperture;

a conveyance member that is provided in the first receiving unit to convey the received toner in a direction across a first direction in which the first receiving unit extends;

a toner container that has a width extending in the first direction to receive and store the toner conveyed by the conveyance member across the width;

an elastic body that supports the toner container against a weight of the toner container so that at least one end of the toner container is movable within a range greater than that of another part of the toner container; and a moving member that moves in accordance with a movement of one end of the toner container, when the elastic body elastically deformed caused by an increase in an amount of toner stored in the toner container;

an image-forming unit that forms a toner image to be transferred onto a recording medium;

an intermediate transfer medium on which the formed toner image is transferred;

a first transfer unit that transfers the formed toner image onto the intermediate transfer medium;

a second transfer unit that transfers the toner image from the intermediate transfer medium onto a recording medium;

a removing unit that removes a toner remaining on a surface of the intermediate transfer medium;

a conveyance unit that conveys the removed toner to the aperture of the collection container;

a second receiving unit that is provided along the first receiving unit, and receives the toner container; and a sheet that is provided on the toner container on the first receiving unit side, and that contacts an inner surface of the second receiving unit when the toner container is accommodated in the second receiving unit, wherein when the toner container is accommodated in the second receiving unit, a top of the toner container on a first receiving unit side is located at a position lower than a top of the second receiving unit on a first receiving unit side.

* * * * *